US010378202B1

(12) United States Patent
Stanfill

(10) Patent No.: US 10,378,202 B1
(45) Date of Patent: Aug. 13, 2019

(54) SKIRTING PANEL

(71) Applicant: Donald E. Stanfill, O'Fallon, MO (US)

(72) Inventor: Donald E. Stanfill, O'Fallon, MO (US)

( * ) Notice: Subject to any disclaimer, the term of this patent is extended or adjusted under 35 U.S.C. 154(b) by 0 days.

(21) Appl. No.: 16/019,959

(22) Filed: Jun. 27, 2018

Related U.S. Application Data

(60) Provisional application No. 62/618,336, filed on Jan. 17, 2018.

(51) Int. Cl.
*E04B 1/343* (2006.01)

(52) U.S. Cl.
CPC ..... *E04B 1/34342* (2013.01)

(58) Field of Classification Search
CPC ..... E04B 1/34342
USPC ..... 52/169.12
See application file for complete search history.

(56) References Cited

U.S. PATENT DOCUMENTS 1,981,434 A * 11/1934 Shodron ..... A01F 25/08 454/174
3,571,998 A * 3/1971 Iacona ..... E04B 1/34342 52/478
3,832,813 A * 9/1974 Hindman ..... E04B 1/34342 52/155
4,043,088 A * 8/1977 Payton ..... E04B 1/34342 52/169.12
4,400,919 A * 8/1983 Szabo ..... E04B 1/34342 280/768
4,549,378 A * 10/1985 Ayers ..... E04B 1/34342 52/169.12
4,843,793 A * 7/1989 Ayers ..... E04B 1/34342 52/169.12
D404,504 S * 1/1999 Dickey ..... D25/125
5,907,933 A * 6/1999 Stanfill ..... E04B 1/34342 52/169.12
6,076,320 A * 6/2000 Butler ..... E02D 27/02 405/229
6,205,725 B1 * 3/2001 Butler ..... E02D 27/00 52/292
2005/0028457 A1 * 2/2005 Davis ..... E02D 27/01 52/169.12

* cited by examiner

*Primary Examiner* — Beth A Stephan
(74) *Attorney, Agent, or Firm* — Thompson Coburn LLP

(57) ABSTRACT

A panel for skirting of a mobile home comprises an extrusion of a polymer material having a thickness of between 0.040 inches and 0.048 inches. The panel has an exterior face comprising a plurality of panel portions separated by grooves formed in the face. Each of the grooves is defined by spaced apart sidewalls arranged generally perpendicular to adjoining panel portions and a groove base extending between the spaced apart side walls. The groove base has vents. On the exterior face, the side wall transitions to the adjoining panel portion with a radius of between about 5/32 inches and about 7/32 inches. On the exterior face, the distance between the groove sidewalls is between about 1/4 inches and about 9/32 inches. The exterior face has an embossed stucco finish. The panel is resistant to damage from grass cutting string trimmers having string diameter of less than 0.105 inches.

5 Claims, 5 Drawing Sheets

SKIRTING PANEL

CROSS-REFERENCE TO RELATED APPLICATION

The present application is a non-provisional application claiming the benefit of U.S. Provisional App. Ser. No. 62/618,336, filed Jan. 17, 2018, which is incorporated herein by reference in its entirety.

BACKGROUND

This disclosure relates generally to skirting panels. More in particular, the disclosure relates to a skirting panel used in connection with mobile homes.

For aesthetic reasons, a mobile home is usually finished with skirting around the bottom perimeter of the home. The bottom skirting conceals from view the bottom support structure of the mobile home. Often, the skirting is adjacent to landscaping. Oftentimes, the panels are damaged by string trimmers used for cutting grass adjacent to the panels.

BRIEF DESCRIPTION OF THE DRAWINGS

The accompanying drawings, which are incorporated in and form a part of the specification, illustrate the aspects of the disclosure.

DETAILED DESCRIPTION

The skirting panel disclosed herein has proven to be resistant to damage caused by grass cutting string trimmers. In particular, the panel has been found to be resistant to damage from grass cutting string trimmers using a string with a diameter up to 0.105 inches. Applicant has determined parameters for the skirting panel which provide superior performance to other panels in the marketplace in connection to withstanding damage to grass cutting string trimmers using a string with a diameter of up to 0.105 inches.

Figure 4:
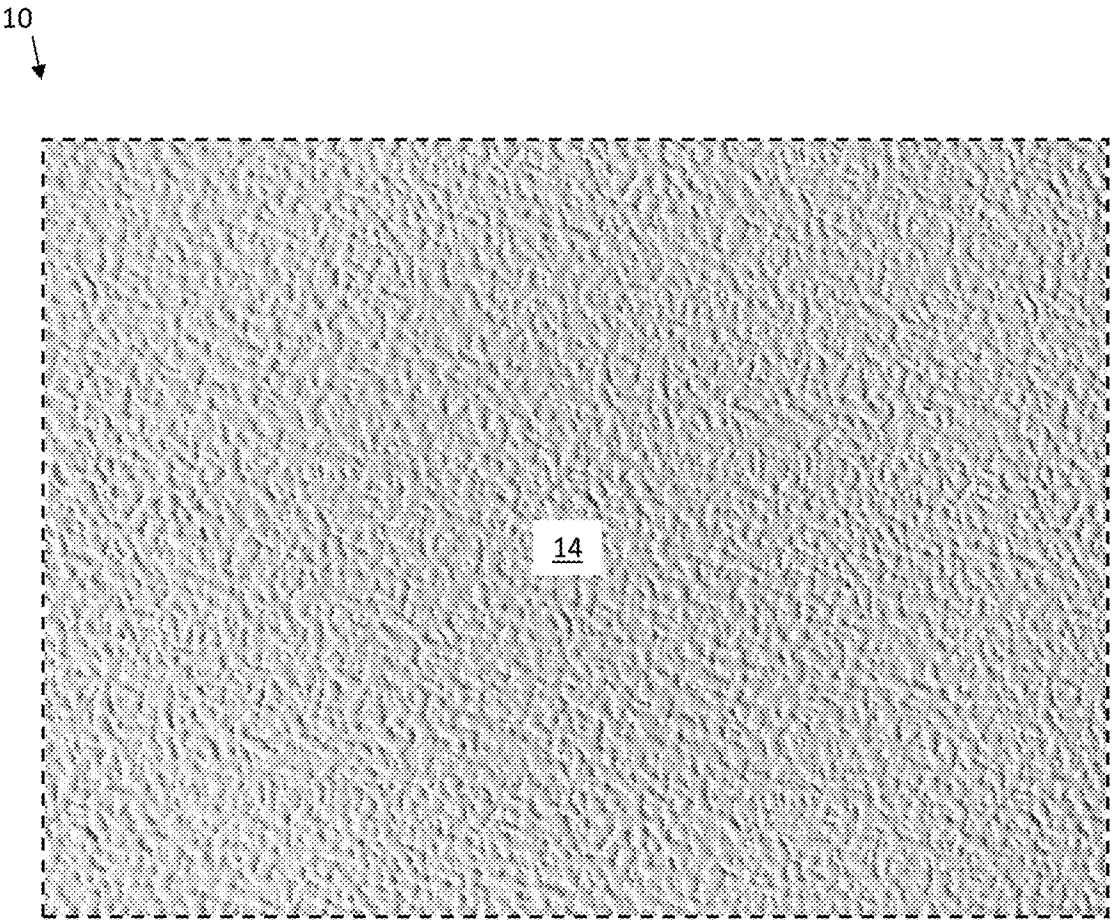
FIG. 4 illustrates an exemplary texture of an exterior of the skirting panel from detail area 4 of FIG. 1.

The exemplary panel 10 comprises an extrusion of a polymer material such as vinyl. The extrusion may have a thickness of between 0.040 inches and 0.048 inches. The thickness of the extrusion is preferably 0.044 inches. The panel 10 has an exterior face 12 with a decorative element 14 and an opposite interior face 16 with no decorative element. The exterior face 12 is intended to face exterior and form an exterior of the mobile home while the interior face 16 is intended to face to the volume of space under the mobile home. The decorative element 14 on the exterior face may be an embossed stucco finish as shown in FIG. 4. The interior face may be smooth. The exterior face 12 comprises a plurality of panel portions 18 that are separated by grooves 20 formed in the exterior face. Each of the grooves 20 is defined by spaced apart sidewalls 22 arranged generally perpendicular to respective adjoining panel portions 18. A groove base 24 extends between the spaced apart side walls 22. The groove base 24 may have vents 26. Accordingly, the grooves project into the volume of space under the mobile home when the panels are installed. The vents 26 may be intermittently spaced along the groove base 24 parallel to the groove 20. The vents 26 may be recessed in the groove base 24. The vents 26 may be formed by spaced apart slits running parallel to the groove. The recessed portion of the vent may be elastically deformed or slightly punched beyond the groove base to form an opening at the slits between the recessed portion of the vent and the base of the groove.

On the exterior face, the sidewall 22 transitions to the adjoining panel portion 18 with a radius 28 that is between about 5/32 inches and about 7/32 inches. The radius 28 is preferably 0.194 inches. On the exterior face, the distance between the spaced apart sidewalls 22 forming the groove may be between about 1/4 inches and about 9/32 inches. On the exterior face (and thus in the groove), the distance between the spaced apart sidewalls 22 forming the groove may be 0.270 inches. The distance between the exterior face of the panel portion 18 and the groove base 24 may be between about 11/32 inches and about 15/32 inches. On the exterior face, the distance between the panel portion 18 and the groove base 24 may be 0.401 inches. For a panel having a thickness of 0.044 inches, the dimensions relative to the interior face 16 may be adjusted accordingly. For instance, on the interior face 16, the sidewall 22 may transition to the adjoining panel portion 18 with a radius of 0.150 inches. Likewise, on the interior face 16, the distance between the spaced apart sidewalls 22 may be 0.358 inches.

Applicant has determined that controlling these dimensions and providing an embossed stucco finish on the exterior face of the panel provides superior resistance to damage from grass cutting string trimmers having a string diameter of 0.105 or less. In particular, applicant has found that the embossed stucco finish eliminates potential fracture paths along the panel. Additionally, applicant has determined that forming the radius 28 between the side wall 22 and adjoining panel portion 18 between about 5/32 inches and about 7/32 inches reduces stress concentration points and provides a smooth transition surface from the groove 20 to the exterior face 12 which is sufficient to prevent damage from grass cutting string trimmers having a string diameter of 0.105 or less in the event the grass cutting string trimmer makes contact with the exterior face of the panel. Applicant has determined that sizing the groove width (i.e., on the exterior face, the distance between the sidewalls 22) prevents the string of the string trimmer from adversely affecting the groove 20 and impacting the groove sidewalls 22. Further, by having a groove 20 formed in the panel projecting inward, the structural integrity of the panel may be increased without creating a feature to be adversely impacted by inadvertent contact with the string of the grass cutting string trimmer. The panel as described above meets at least 1.9 in-lbs/mil as measured via Drop Dart Impact Resistance Procedure A, 73° F. ASTM D4226, and at least 4.0 in-lbs/mil as measured via Drop Dart Impact Resistance Procedure B, 73° F. ASTM D4226.

Figure 1:
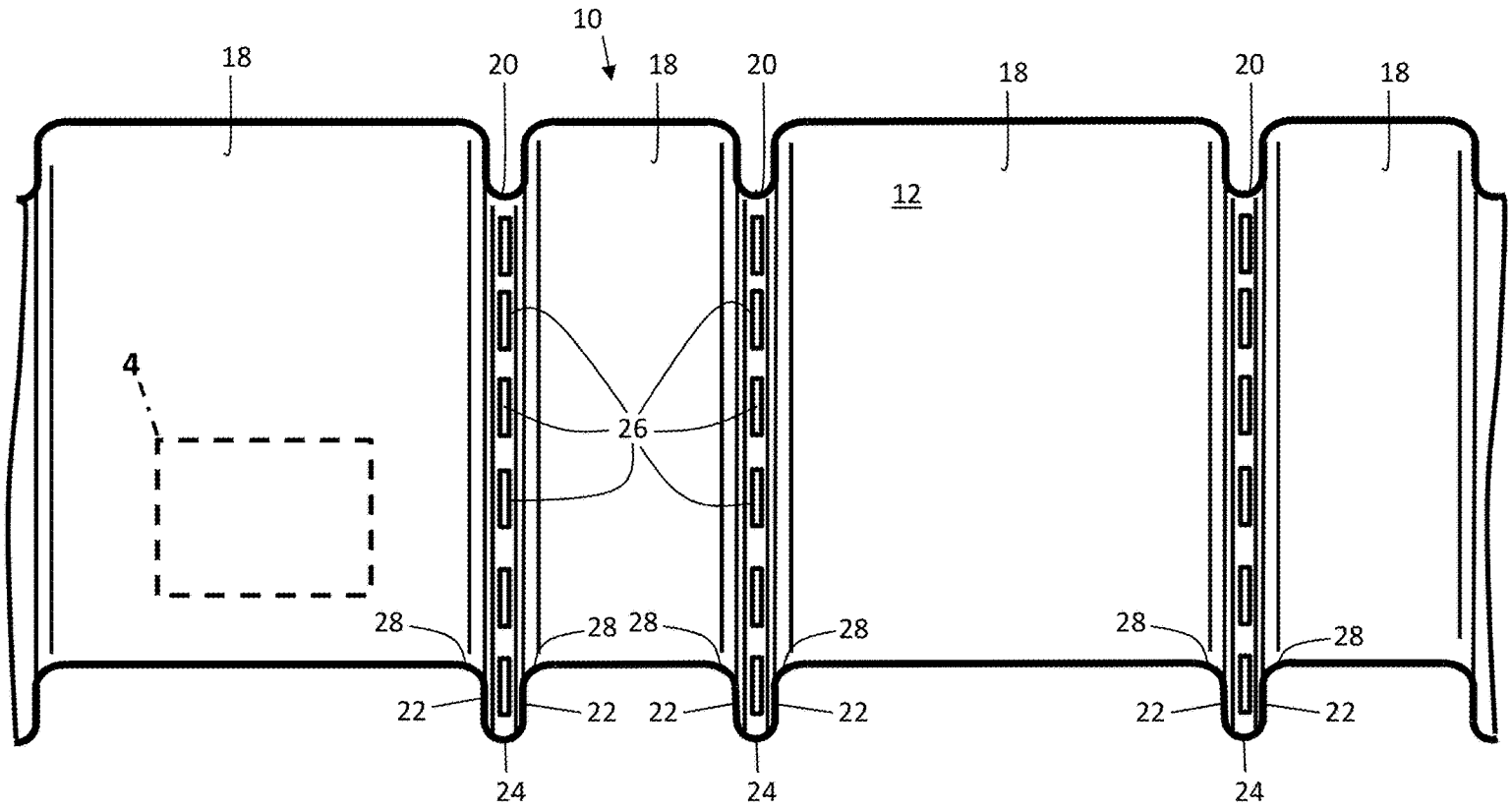
FIG. 1 illustrates a plan view showing an exterior face of a section of an exemplary skirting panel.
Figure 2:
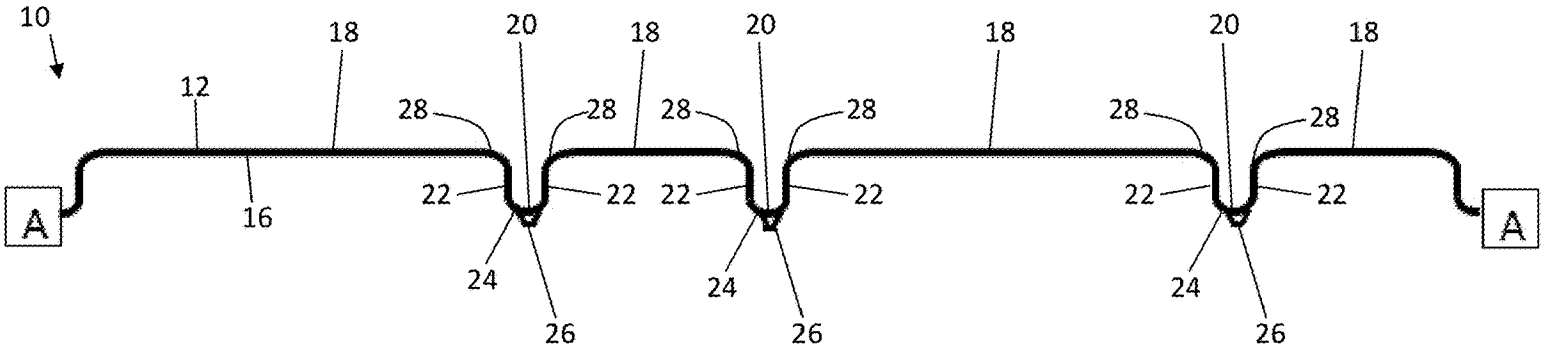
FIG. 2 illustrates a side view of a section of the skirting panel of FIG. 1.
Figure 3A:
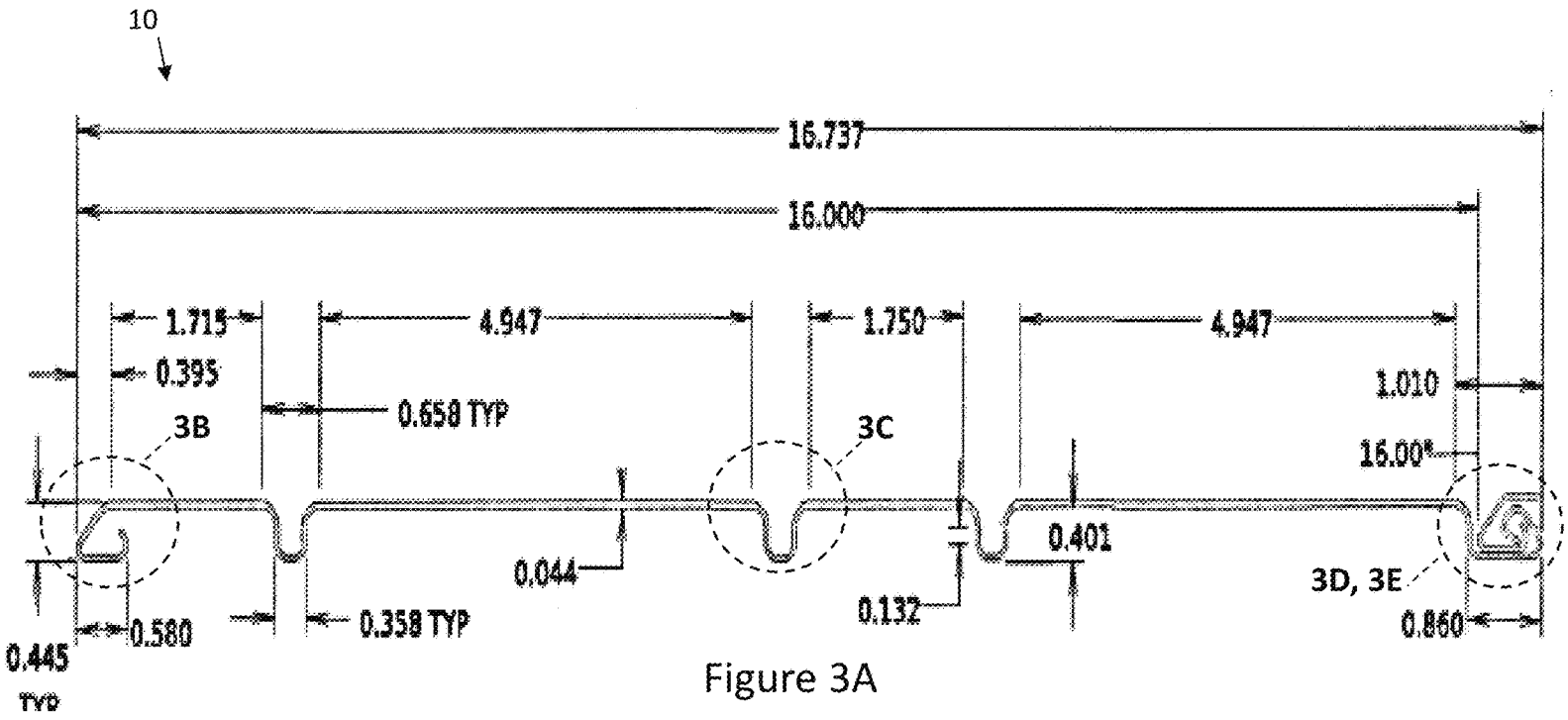
FIG. 3A illustrates an exemplary embodiment of a skirting panel.
Figure 3C:
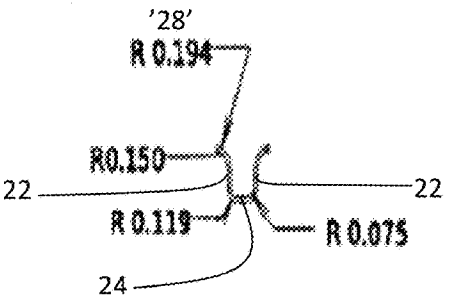
FIG. 3C illustrates a portion of the skirting panel from detail area 3C of FIG. 3A.
Figure 3B:
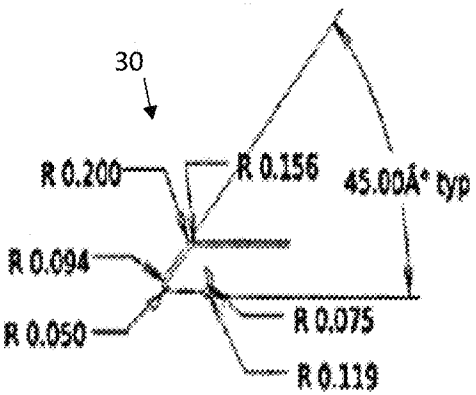
FIG. 3B illustrates a portion of the skirting panel from detail area 3B of FIG. 3A.
Figure 3E:
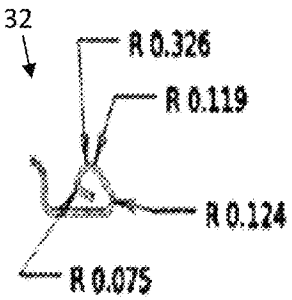
FIG. 3E illustrates a portion of the skirting panel from detail area 3E of FIG. 3A.
Figure 3D:
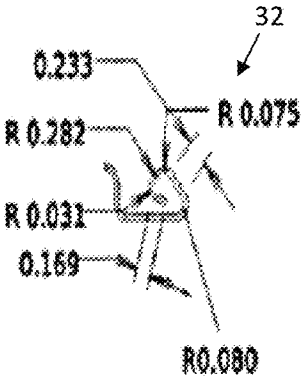
FIG. 3D illustrates a portion of the skirting panel from detail area 3D of FIG. 3A.

The panel 10 may be provided in 16 inch wide panels. The panel 10 may be provided in a pattern which repeats at reference character A in FIG. 2. There may be three grooves

20 and four panel portions 18 on a 16 inch wide panel. The panel may have first and second opposite marginal edges that extend parallel to the grooves. The first and second marginal edges may have cooperating interlocking portions 30,32 (FIG. 3A, 3B, 3D) such that the first marginal edge of the panel is releasably connectable with the second marginal edge of a like side by side adjoining panel. The 16 inch wide panel may have a weight of 92 ounces. The panel may be provided with other dimensions as shown in FIGS. 3A-3E, which are intended to be illustrative and not limiting.

The panel may have other features allowing it to be installed in mounting tracks that may be provided or installed on the underside of the mobile home and adjacent the ground below the periphery of the mobile home. For instance, U.S. Pat. Nos. 5,907,933 and 9,187,893, which are incorporated by reference herein disclose such a mounting system.

The embodiments were chosen and described in order to best explain the various aspects of the disclosure and their practical application. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A panel for skirting of a mobile home, the panel comprising an extrusion of a polymer material having a thickness of between 0.040 inches and 0.048 inches, the panel having an exterior face comprising a plurality of panel portions separated by grooves formed in the face, each of the grooves being defined by spaced apart sidewalls arranged generally perpendicular to adjoining panel portions and a groove base extending between the spaced apart sidewalls, the groove base having vents, on the exterior face, the sidewalls transitioning to the panel portions with a radius of between about 5/32 inches and about 7/32 inches, on the exterior face, the distance between the groove sidewalls being between about 1/4 inches and about 9/32 inches, and the exterior face having an embossed stucco finish.

2. The panel of claim 1 wherein the distance between the exterior face and the groove base being between about 11/32 inches and about 15/32 inches.

3. The panel of claim 1 wherein the panel has first and second opposite marginal edges parallel to the grooves, the first and second marginal edges have cooperating interlocking portions such that the first marginal edge of the panel is releasably connectable with a second marginal edge of a side-by-side adjoining panel.

4. The panel of claim 1 wherein the panel meets at least 1.9 in-lb/mil as measured via a Drop Dart Impact Resistance Procedure A, 73° F. ASTM D4226 test.

5. The panel of claim 1 wherein the panel meets at least 4.0 in-lb/mil as measured via a Drop Dart Impact Resistance Procedure B, 73° F. ASTM D4226 test.

* * * * *